US006551206B2

(12) United States Patent
Ha

(10) Patent No.: US 6,551,206 B2
(45) Date of Patent: Apr. 22, 2003

(54) MULTI-PURPOSE RACKET

(76) Inventor: Woong Soo Ha, 428 HO A-Dong, Business College Pusan University, Jangjoeng 2dong Geurnjoeagku, Pusan (KR)

( * ) Notice: Subject to any disclaimer, the term of this patent is extended or adjusted under 35 U.S.C. 154(b) by 0 days.

(21) Appl. No.: 10/083,118

(22) Filed: Feb. 27, 2002

(65) Prior Publication Data

US 2003/0054907 A1 Mar. 20, 2003

(30) Foreign Application Priority Data

Sep. 17, 2001 (KR) ..... 2001-0028594 U

(51) Int. Cl.[7] ..... A63B 49/00

(52) U.S. Cl. ..... 473/527; 473/524; 473/520; 473/529

(58) Field of Search ..... 473/520, 524, 473/527, 528, 529, 530, 531

(56) References Cited

U.S. PATENT DOCUMENTS

| | | | | | |
|---|---|---|---|---|---|
| 1,986,154 | A | * | 1/1935 | Marks | 473/527 |
| 3,091,461 | A | * | 5/1963 | Taylor | 273/146 |
| 3,879,250 | A | * | 4/1975 | Rankin, Jr. | 156/228 |
| 4,128,239 | A | * | 12/1978 | Grenadier | 473/530 |
| 4,411,427 | A | * | 10/1983 | Baumgartner | 473/530 |
| 5,080,374 | A | * | 1/1992 | Yu | 273/DIG. 30 |
| 5,165,684 | A | * | 11/1992 | Pratt | 273/DIG. 30 |
| 5,253,874 | A | * | 10/1993 | Hoffman | 273/412 |
| 5,261,673 | A | * | 11/1993 | Miller | 273/412 |
| 5,265,883 | A | * | 11/1993 | Choo | 273/DIG. 25 |
| 5,961,404 | A | * | 10/1999 | Gormley | 473/524 |

FOREIGN PATENT DOCUMENTS

| | | | | |
|---|---|---|---|---|
| DE | 2545233 | * | 4/1977 | 473/FOR 174 |
| GB | 607255 | * | 8/1948 | 473/FOR 174 |
| GB | 1242704 | * | 8/1971 | 473/FOR 174 |

* cited by examiner

*Primary Examiner*—Raleigh W. Chiu
(74) *Attorney, Agent, or Firm*—Bacon & Thomas

(57) ABSTRACT

A multi-purpose racket. The multi-purpose racket includes a striking blade and a shaft. The striking blade includes a hollow substrate consisting of first and second flat sheets and partition walls successively arranged between the two flat sheets to form cells in the substrate. In this striking blade, a hard layer is attached to the outer surface of the first sheet of the substrate for allowing a user to strike a ball strongly. A sub-layer is attached to the outer surface of the second sheet of the substrate and acts as a cushion. In addition, a soft layer is attached to the outer surface of the sub-layer and has densely packed hook members over its whole external surface. The racket of this invention allows a user to strike various kinds of balls.

4 Claims, 5 Drawing Sheets

MULTI-PURPOSE RACKET

BACKGROUND OF THE INVENTION

1. Field of the Invention

The present invention relates generally to a multipurpose racket designed to allow a user to enjoy a variety of ball games, and more particularly, to a multi-purpose racket, which includes opposite surfaces designed to have different properties respectively, thus allowing a user to selectively strike a hard ball or a soft ball. Furthermore, this invention relates to a multi-purpose racket, which allows a user to strike a shuttlecock as well as various kinds of balls and is improved to substitute for a netting used in a conventional racket, so it is not necessary to frequently replace the cut netting with a new one or do away with the racket having such a cut netting.

2. Description of the Prior Art

Many people have increased free time due to economic advances, so leisure time amusements have been developed in order to meet the demand of people to enjoy such a free time. Particularly, there has gradually increased the number of people who enjoy playing tennis and badminton, as representative sports. In addition, new racket sports, such as squash, are continuously created.

A ball and racket are indispensable for the sports, including the tennis, the badminton and the squash. However, such sports equipments are usually expensive. In addition, the netting included in the racket is frequently cut, so a user must frequently purchase and replace the netting, thus being inconvenient for a user, in addition to forcing the user to pay money.

A conventional multi-purpose racket disclosed in Korean Utility Model Appln. No. 92-9180 is as follows. This conventional racket is designed to be used for many purposes. That is, a user can simultaneously enjoy playing tennis and badminton, and catching a ball, with only one racket. FIG. 1 is a perspective view showing the conventional multi-purpose racket, and FIG. 2 is an exploded perspective view of the racket of FIG. 1.

Referring to the drawings, the conventional racket 1 is made of synthetic resin, and has a single structure which is made up of a frame 2, a net plate 4 covered on its surface with a netting 3, a neck 10 and a handle 11. The net plate 4 forming the front face of a striking blade of the racket 1 is bent along its outer circumferential edge to form an inside wall. A plurality of holes 5 are bored through the net plate 4. The circular frame 2 forms an outside wall 6 to form a circular fitting groove 7 between the two walls. A ball catching plate 9 is assembled with the striking blade of the racket 1 to form the rear surface of the racket 1. This plate 9 is covered with a non-woven fabric 8, which is densely provided on its surface with a plurality of hook members in the same manner as the hook piece of a Velcro fastener. This catching plate 9 is provided on its outer circumferential surface with a fitting edge 9'. The fitting edge 9' engages with the circular fitting groove 7, thus forming the rear surface of the striking blade. The handle 11 is integrated with the neck 10, and has locking holes 12 therein so as to receive locking pins 13' of a handle cover 13.

The above conventional multi-purpose racket is designed such that it is provided on its one surface with a net-covered striking blade made of synthetic resin in place of using a typical netting, and provided on the other surface with a detachably mounted ball catching plate.

However, the conventional multi-purpose racket has a problem that it has a hard striking blade which is provided with a net on its surface and made of synthetic resin, so it cannot sufficiently absorb shock. This multi-purpose racket has another problem that it has a complicated shape and construction, so its manufacturing cost is undesirably high. This racket has still another problem that its ball catching plate is attached to the striking blade using an additional member, so the weight of the racket is undesirably increased and it is complicated to manufacture the racket.

SUMMARY OF THE INVENTION

Accordingly, the present invention has been made keeping in mind the above problems occurring in the prior art, and an object of the present invention is to provide a multi-purpose racket, which is designed such that its shaft can be separated from the striking blade, and the striking blade of which is formed in such a way as to have several layers of different materials so as to use the striking blade for many purposes, thus allowing a user to strike various kinds of balls, using one racket.

Another object of the present invention is to provide a multi-purpose racket, which is reduced in its weight as well as its manufacturing cost.

In order to accomplish the above object, the present invention provides a multi-purpose racket consisting of a striking blade and a shaft, the striking blade comprising: a hollow substrate consisting of first and second flat sheets and a plurality of partition walls successively arranged between the two flat sheets to form a plurality of cells in the substrate; a hard layer attached to the outer surface of the first sheet of the substrate for allowing a user to strike a ball strongly; a sub-layer attached to the outer surface of the second sheet of the substrate and acting as a cushion; and a soft layer attached to the outer surface of the sub-layer and having a plurality of densely packed hook members over its whole external surface, whereby the racket allows a user to strike various kinds of balls using one racket.

The present invention provides a multi-purpose racket, which is designed to have one surface made of a hard layer and the other surface made of a soft layer, thus allowing a user to strike a ball with either surface of the racket selected according to the kinds of balls, and sufficiently absorbing shock so as to prevent unexpected strong impact from being applied to the user.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
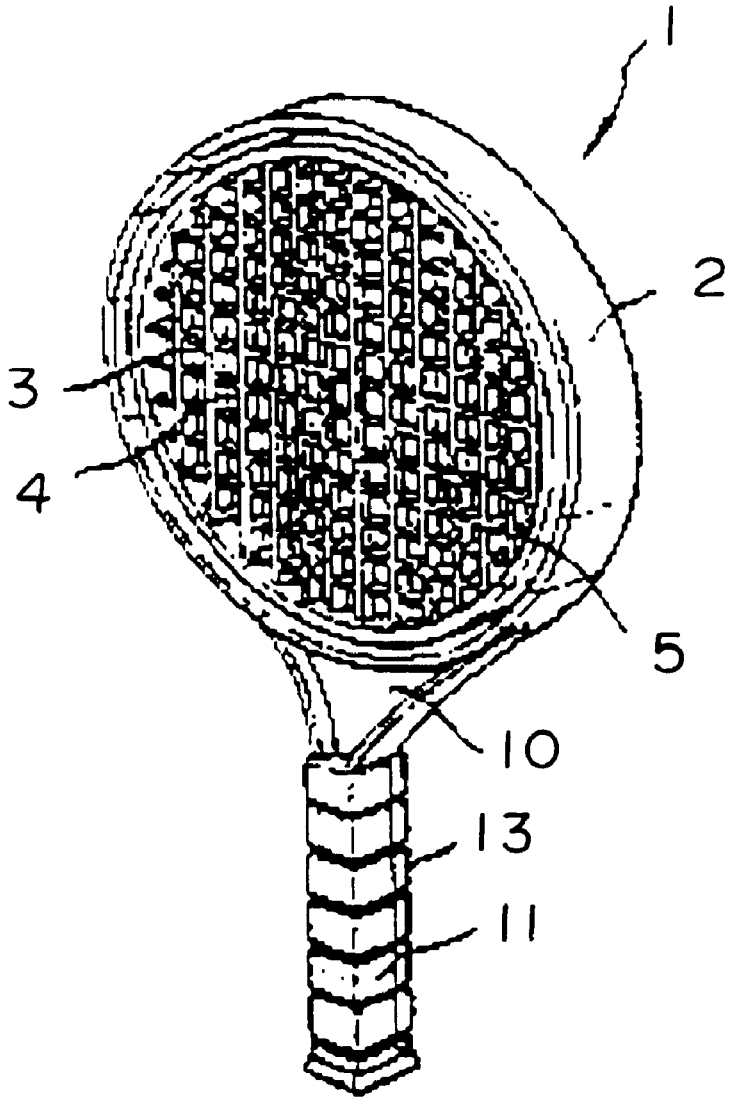
FIG. 1 PRIOR ART
FIG. 1 is a perspective view showing a conventional multi-purpose racket.
Figure 2:
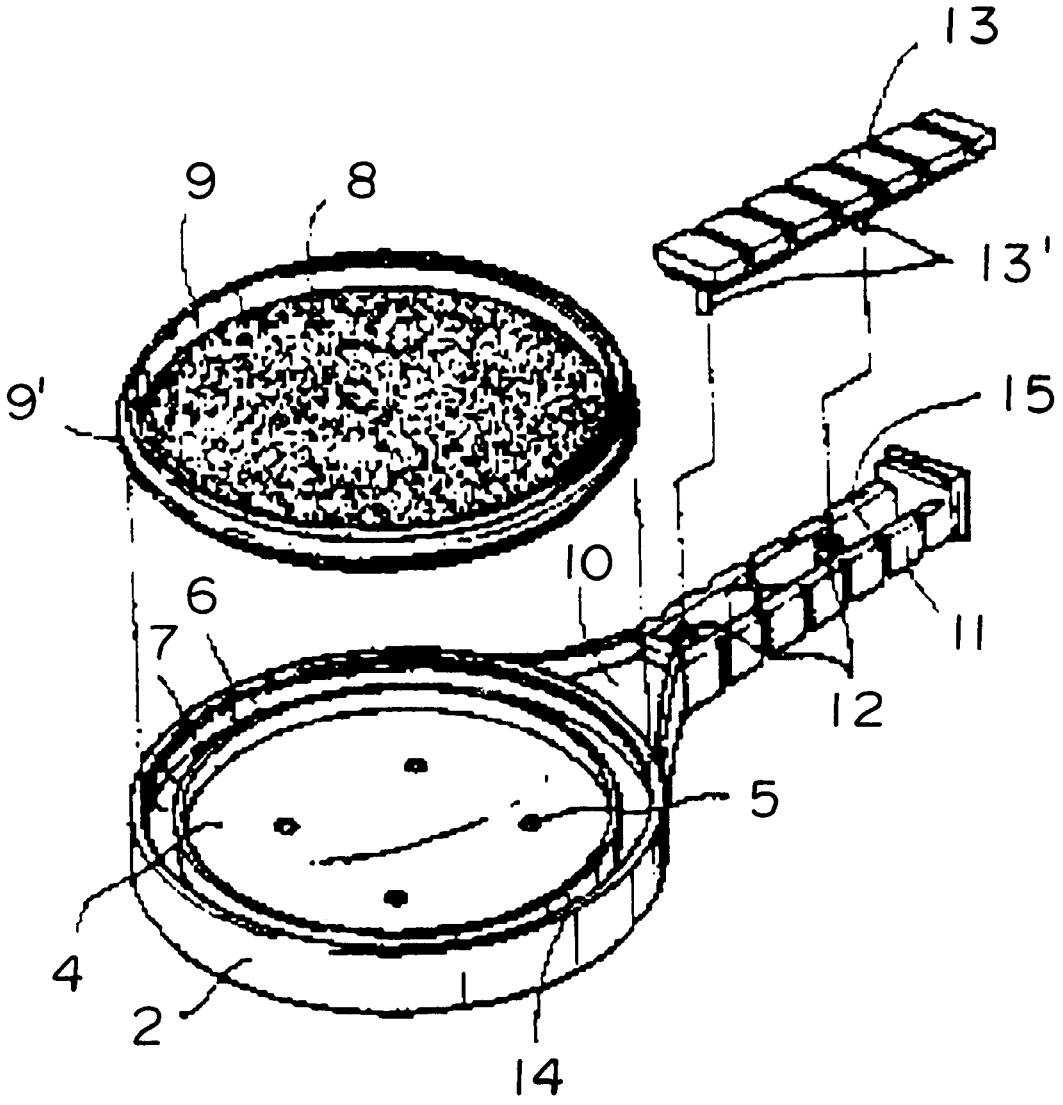
FIG. 2 PRIOR ART
FIG. 2 is an exploded perspective view of the conventional racket shown in FIG. 1.

Reference now should be made to the drawings, in which the same reference numerals are used throughout the different drawings to designate the same or similar components.

Figure 3A:
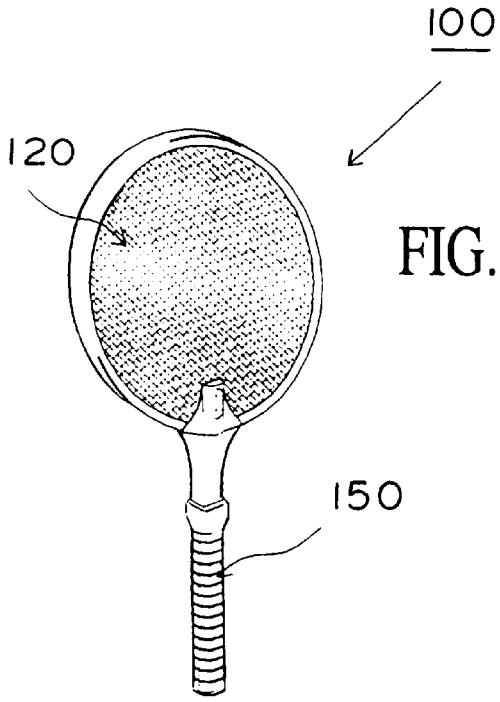
FIG. 3*a* is a perspective view of a multipurpose racket according to the first embodiment of this invention.
Figure 3B:
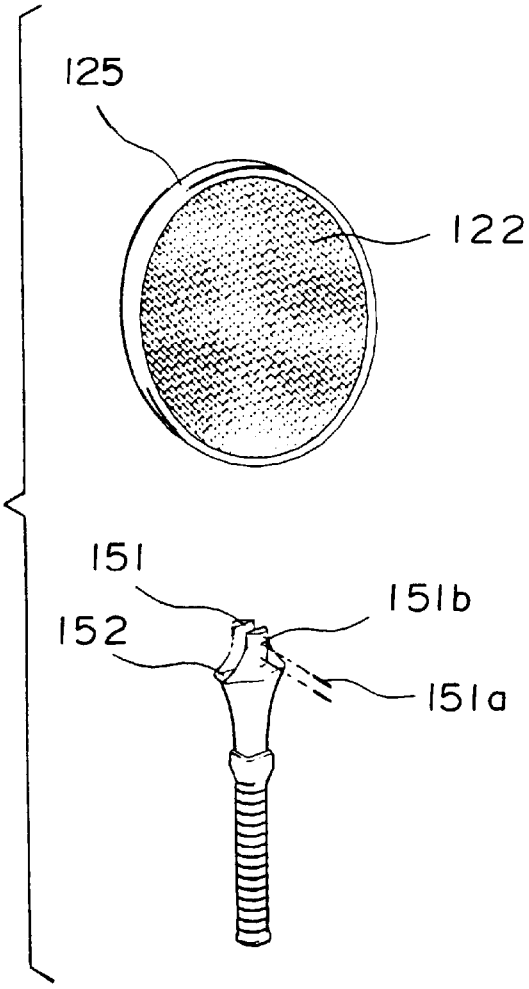
FIG. 3*b* is an exploded perspective view of the multipurpose racket according to the first embodiment of this invention.

FIG. 3*a* is a perspective view of a multi-purpose racket according to the first embodiment of this invention, and FIG. 3*b* is an exploded perspective view of the multi-purpose racket shown in FIG. 3*a*.

As shown in the drawings, the multi-purpose racket 100 is made up of a striking blade 120 and a shaft 150, thus forming a racket shape. In the racket 100 of this invention, the striking blade 120 and the shaft 150 are individually manufactured, and then they are assembled with each other into a single body. The striking blade 120 is fitted into a protective frame 125 along its outer circumferential surface.

Figure 4:
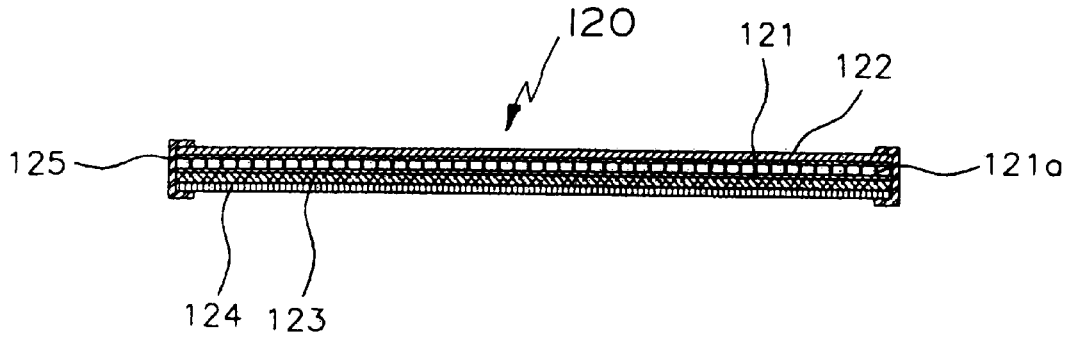
FIG. 4 is a side view of the striking blade included in the multi-purpose racket according to the first embodiment of this invention.

FIG. 4 is a side view of the striking blade 120 included in the multi-purpose racket according to the first embodiment of this invention. The striking blade 120 consists of a substrate 121, a hard layer 122, a sub-layer 123 and a soft layer 124.

The substrate 121 is made of synthetic resin, light in weight, but which isn't plastically deformed in shape when striking a ball. According to the first embodiment of this invention, the substrate 121 consists of opposite flat sheets and a plurality of partition walls 121*a*, such that the partition walls 121*a* are successively arranged between the two flat sheets, thus forming a plurality of cells in the substrate 121 as well as connecting the two sheets to each other. Since the two opposite sheets of the substrate 121 are connected to each other by the partition walls 121*a*, the substrate 121 has elasticity to some extent, but there occurs no plastic deformation in the substrate 121 when striking a ball.

In the first embodiment of this invention, the substrate 121 is designed to have successive cells formed by the linear partition walls 121*a*. However, the substrate 121 may be designed to have honeycomb-shaped or latticed cells without limiting the above embodiment.

The hard layer 122 is described as follows. The hard layer 122 is attached to one sheet of the substrate 121, and is made of a cloth having a predetermined thickness, and has proper elasticity. It is preferable to strike balls requiring a strong power, such as a tennis ball, with the hard layer 122.

The sub-layer 123 and the soft layer 124 are sequentially attached to the other sheet of the substrate 121 opposite to the hard layer 122. The sub-layer 123 is made of a soft material, such as sponge. The soft layer 124 is attached to the sub-layer 123. According to the first embodiment, the soft layer 124 is made of a non-woven fabric having a plurality of densely packed hook members. Thus, when using a ball provided on its surface with a dense pile, the ball may be attached to the soft layer 124 by interlocking the hook members with the dense pile. The soft layer 124 is useful for striking a ball which does not require a strong power, such as a shuttlecock for badminton. It is preferable to use a non-woven fabric, having dense hooks on its surface, in the same manner as that of the hook piece of a hook-and-loop fastener (available under the trademark VELCRO), for the soft layer 124.

As described above, the protective frame 125 surrounds the striking blade 120, consisting of the substrate 121, the hard layer 122, the sub-layer 123, and the soft layer 124, along the outer circumferential surface of the striking blade 120 in such a way as to hold the hard layer 122 and the soft layer 124 while serving as a closure member. The protective frame 125 has a U-shaped cross-section and is made of plastic having superior elasticity. The protective frame 125 is arranged to cover the edges of the hard layer 122 and the soft layer 124 in the process of assembling them, and then both ends of the frame 125 are connected to each other. The protective frame 125 prevents the substrate 121, the hard layer 122, and the soft layer 124 from becoming worn, and serves as a closure member for allowing the racket 100 to have a good appearance.

The shaft 150 assembled with the striking blade 120 will be described in the following. On the upper portion of the shaft 150 is formed a clamping part 151 which is provided with pin holes 151*b* for receiving locking pins 151*a* when the shaft 150 is assembled with the striking blade 120. The clamping part 151 is also provided with a seat 152 in which the bottom surface of the striking blade 120 is seated when the striking blade 10 covered with the protective frame 125 is connected to the shaft 150.

According to the preferred embodiment of this invention, the multi-purpose racket is designed such that the striking blade and the shaft are separately manufactured and then they are connected to each other into a single body, so the racket is easy to manufacture in addition to having superior elasticity, in comparison with the conventional racket having a single structure.

The operation principle of the multi-purpose racket of this invention is as follows. That is, when a ball contacts the hard layer or soft layer of the striking blade, shock is primarily absorbed by the hard layer or soft layer. Thereafter, the substrate having a plurality of cells is elastically deformed and provides a repelling force within predetermined elasticity extent, in addition to secondarily absorbing the shock, therefore transmitting minimum shock to the shaft.

Figure 5:
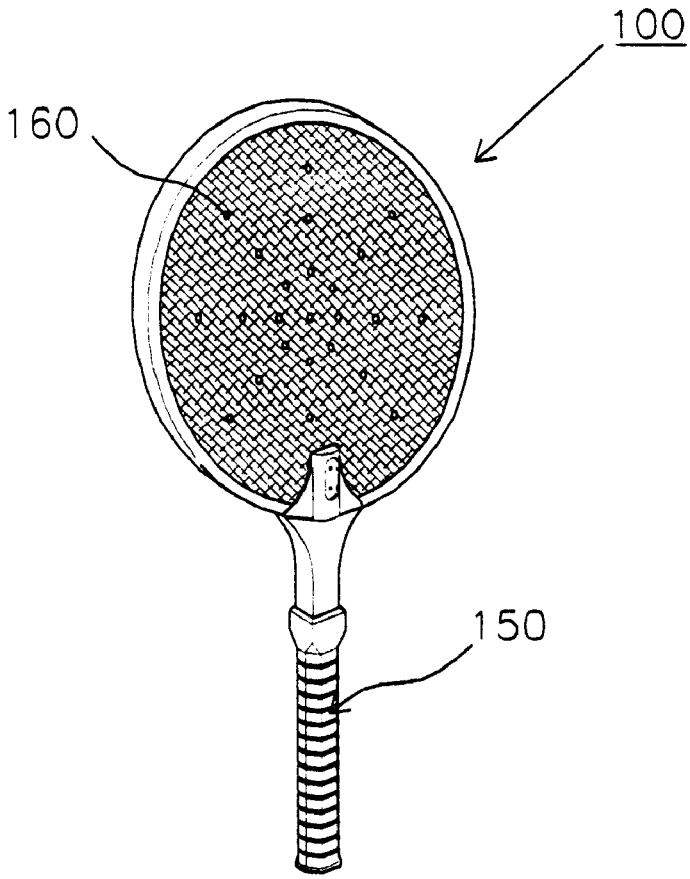
FIG. 5 is a perspective view of a multi-purpose racket according to the second embodiment of this invention.

The second embodiment of this invention will be described with reference to FIG. 5. FIG. 5 is a perspective view of a multi-purpose racket according to the second embodiment of this invention. This racket 100 includes a shaft 150 and a striking blade consisting of a substrate, a hard layer, a sub-layer, and a soft layer, similarly to the racket of the first embodiment. However, the racket 100 of the second embodiment is designed such that a plurality of holes 160 are formed through the striking blade. The holes 160 are radially arranged on the striking blade, and reduce weight of the racket, so the racket is convenient to carry, and is easily used by children as well as adults.

As described above, the present invention provides a multi-purpose racket, which allows a user to strike various kinds of balls with only one racket, so it does not force the user to purchase many rackets according to the kinds of games. This invention provides a multipurpose racket, which has sufficient elasticity without using a netting, differently from typical rackets, thus reducing cost required to repair the netting.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multi-purpose racket consisting of a striking blade and a shaft, said striking blade comprising:

a hollow substrate consisting of first and second flat sheets and a plurality of partition walls successively arranged between said flat sheets to form a plurality of cells in the substrate;

a hard layer attached to an outer surface of the first sheet of said substrate for allowing a user to strike a ball strongly;

a sub-layer attached to an outer surface of the second sheet of said substrate and acting as a cushion; and a soft layer attached to an outer surface of said sub-layer and having a plurality of densely packed hook members throughout a whole surface thereof, whereby the racket allows a user to strike various kinds of balls.

2. The racket according to claim 1, wherein said striking blade is provided with a protective frame along an outer circumferential surface thereof, said protective frame having a U-shaped cross-section.

3. The racket according to claim 1 or 2, wherein said shaft has a clamping part for holding opposite surfaces of the striking blade and a bottom surface of the protective frame at the same time.

4. The racket according to claim 1 or 2, wherein said striking blade has a plurality of perforations, each extending thoroughly from one to the other surface thereof.

* * * * *